United States Patent [19]

Julian

[11] Patent Number: 4,949,612

[45] Date of Patent: Aug. 21, 1990

[54] APPARATUS FOR SLICING VEGETABLES

[76] Inventor: John C. Julian, 1914 Hood St., Richmond, Wash. 99352

[21] Appl. No.: 394,216

[22] Filed: Aug. 15, 1989

[51] Int. Cl.[5] ..... B26D 3/28

[52] U.S. Cl. ..... 83/403; 83/404.3; 83/856

[58] Field of Search ..... 83/403, 404.3, 698, 83/856-858, 417; 384/484, 486, 147, 148

[56] References Cited

U.S. PATENT DOCUMENTS

| | | | |
|---|---|---|---|
| 2,858,176 | 10/1958 | Thompson | 384/486 X |
| 3,139,127 | 6/1964 | Urschel et al. | 83/403 X |
| 3,139,130 | 6/1964 | Urschel et al. | 83/417 |
| 3,397,020 | 8/1968 | Edwards | 384/484 |
| 3,531,168 | 9/1970 | Bainard | 384/486 |
| 3,813,102 | 5/1974 | Derman | 384/484 X |
| 4,523,503 | 6/1985 | Julian et al. | 83/403 |
| 4,575,265 | 3/1986 | Tooley | 384/484 X |
| 4,697,937 | 10/1987 | Karlsson et al. | 384/486 |

*Primary Examiner*—Hien H. Phan

*Assistant Examiner*—Eugenia A. Jones

*Attorney, Agent, or Firm*—Klarquist, Sparkman, Campbell, Leigh & Whinston

[57] ABSTRACT

An apparatus for slicing vegetables includes a stationary member holding stationary knives about the periphery of a rotating impeller hub. The hub has a hollow central opening for receiving vegetables. A plurality of circular tubular extensions having circular openings therein extending radially from the central opening in the impeller hub. Each circular opening has an impeller tube located therein. The impeller tube transports the vegetable outwardly by centrifugal force against the cutting knives. As the impeller hub rotates inside the stationary knife holding member the impeller tube simultaneously rotates upon the impeller hub such that each successive slice of the vegetable is at an angle, preferably 90 degrees, to the preceding slide. A bearing is located between the impeller tube and the impeller hub to allow this relative rotation. A pair of seals, one on each side of the bearing, prevents water and other contaminants from entering the bearing.

10 Claims, 2 Drawing Sheets

APPARATUS FOR SLICING VEGETABLES

TECHNICAL FIELD

The present invention relates generally to food processing and, in particular, to improvements in a machine used to slice vegetables and more particularly to a machine to slice potatoes to make waffle cut potato chips.

BACKGROUND ART

A waffle cut potato chip characteristically has longitudinal ridges and grooves formed in both cut surfaces to give it a corrugated shape. The grooves on one surface are perpendicular to the ridges and grooves on the opposite surface. The grooves are sufficiently deep such that the grooves of one cut surface intersect those of the other cut surface to form a grid of openings in the chip.

The only known commercially available potato slicing machine for making waffle cut potato chips is substantially like that shown in Urschel, U.S. Pat. Nos. 3,139,127 and 3,139,130, manufactured by Urschel Laboratories, Inc., Valparaiso, Ind. as model "CCL". In operation, whole potatoes are received by a central rotating carriage or impeller hub and fed outwardly by centrifugal force into one of several radial guides or impeller tubes which simultaneously rotate and direct the potatoes to a stationary cutting assembly surrounding the impeller hub. The cutting assembly includes a plurality of circumferentially spaced corrugated knives that project into the path of the orbiting potatoes to cut away thin slices of the potatoes, shunting the slices tangentially away from the cutting assembly as they are cut. Means are provided to cause the impeller tubes, and hence the potatoes carried therein, to rotate 90 degrees within the impeller hub in between successive cuts of the potato. In this way the corrugated knives slice the potatoes into thin potato slices having ridges and grooves on one side that are perpendicular to the ridges and grooves on the other side.

Various modifications and improvements have been made to this basic machine. For example, Julian et al. U.S. Pat. No. 4,523,503 improved the knives and the knife holders used to slice the potatoes. The machine, although adequate for its intended function, still has some problems capable of improvement. One of the major problems is bearing life.

The impeller tubes rotate about the impeller hub in order to cause the potatoes to rotate 90 degrees between each successive slice. A bearing is located between the impeller hub and the impeller tube to ensure smooth rotation. This bearing is susceptible to being contaminated by water and solid materials which flow between the impeller tube and the impeller hub. The bearings are about six inches in diameter are very expensive to replace. The contamination of these bearings causes them to have a life of approximately 250 hours. The bearings currently are lubricated by a human consumable vegetable type grease. Even with proper maintenance and greasing schedules, the grease is insufficient to keep the moisture and contaminants from destroying the bearings.

It is therefore an object of this invention to improve the sealing between the impeller hub and the impeller tube to prevent the bearings from being contaminated by water and solid material.

It is also an object of this invention to sufficiently seal the bearings such that a lubricating grade grease may be used to lubricate the bearings.

It is a further object of this invention to provide a relief in the impeller tube to allow moisture to be slung out away from the bearings during operation.

Still another object of this invention is to improve the performance and reduce the maintenance costs of waffle cut slicing apparatus having a central hub which rotates about a vertical axis and at least one rotatably connected impeller tube which rotates about a horizontal axis aligned radially with respect to the hub's vertical axis.

SUMMARY OF THE INVENTION

A framework holds a stationary knife-supporting member about a rotating impeller assembly. The impeller assembly is comprised of an impeller hub having a central, vertical opening into which a product to be sliced is fed. The impeller hub has a plurality of tubular extensions extending radially outward from the central portion of the impeller hub. An impeller tube is centrally located within each tubular extension of the impeller hub. An impeller bevel gear is attached to each impeller tube by suitable fastening means. A bearing riding on each tubular extension has an inner race which contacts the tubular extension of the impeller hub. The outer race of the bearing rests against and rotatably supports the impeller bevel gear. A snap ring fitting in a groove of the tubular extension of the impeller hub prevents the bearing from being laterally displaced. A spacer of the same thickness as the snap ring entraps the outer race of the bearing between the impeller tube and the impeller bevel gear. A first seal is located in a recess of the impeller tube outboard of the snap ring and the spacer and effectuates a seal between the impeller tube and the tubular extension of the impeller hub. A second seal fits in a recess of the impeller bevel gear and seals the impeller bevel gear to the tubular extension of the impeller hub inboard of the bearing. A drain hole is provided in the impeller tube to sling any water which may come between the impeller tube and the impeller hub out away from the first seal. A grease fitting is provided in the impeller bevel gear to allow grease to be forced into a cavity located adjacent to the bearing to lubricate the bearing. The first seal and second seal prevent the grease from coming outside the impeller tube and impeller bevel gear assembly. To effectuate proper seating of the bearing and the two seals, the tubular extension of the impeller hub has a first step for receiving the bearing and a second step for receiving the second seal.

In practice the product to be sliced, typically a potato, is transported into the central opening of the impeller hub. The impeller hub is rotated in a circular manner by a drive means centrally located to the impeller hub. The potato is forced outwardly by centrifugal force into the opening in the center of one of the impeller tubes. Serrated toothed members inside the impeller tube prevent the potato from rolling in the tube and from working back toward the center of the impeller hub. The impeller bevel gears rest in tooth-to-tooth relationship with a fixed bevel gear which is attached to the frame. As the impeller hub is rotated within the surrounding fixed knife support assembly, the impeller bevel gear rotates the impeller tube such that the surface of the potato being sliced is rotated ninety degrees relative to the preceding slice. In this manner waffle cut potatoes having corrugated cuts on one surface and corrugated cuts on the second surface at ninety degrees to the first surface are formed.

DETAILED DESCRIPTION OF THE INVENTION

Figure 1:
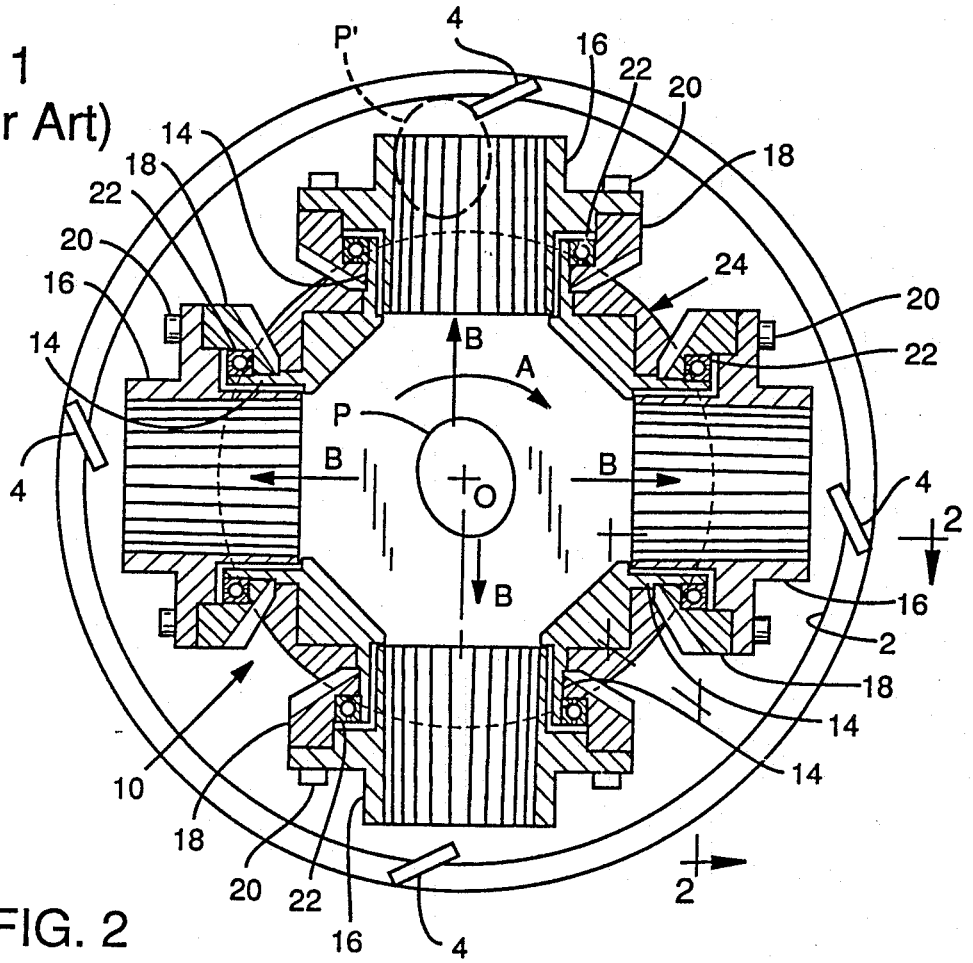
FIG. 1 (Prior Art)
FIG. 1 is a top view of a prior art apparatus for producing waffle cut potato chips with the impeller assembly shown in cross section.
Figure 2:
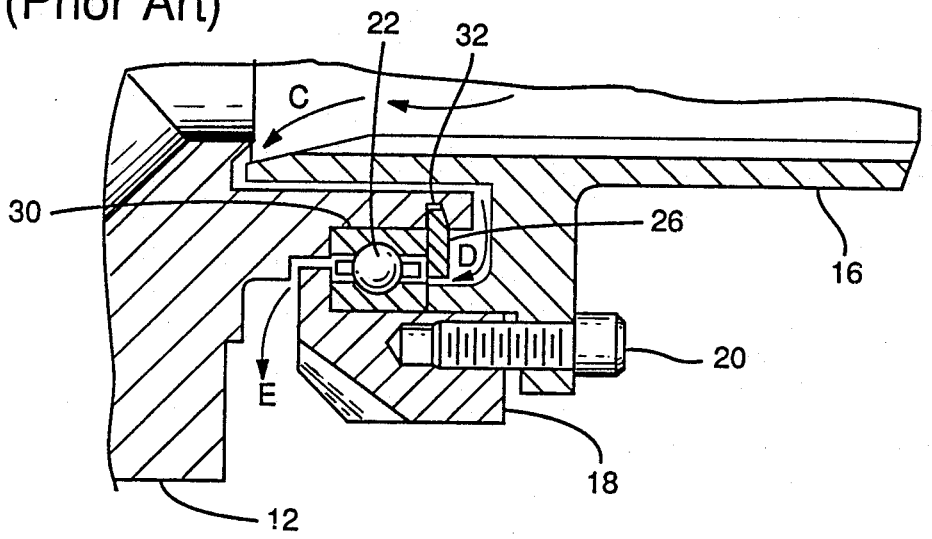
FIG. 2 (Prior Art)
FIG. 2 is an enlarged view of a portion of the cross section of the impeller assembly broken away along lines 2—2 of FIG. 1.
Figure 3:
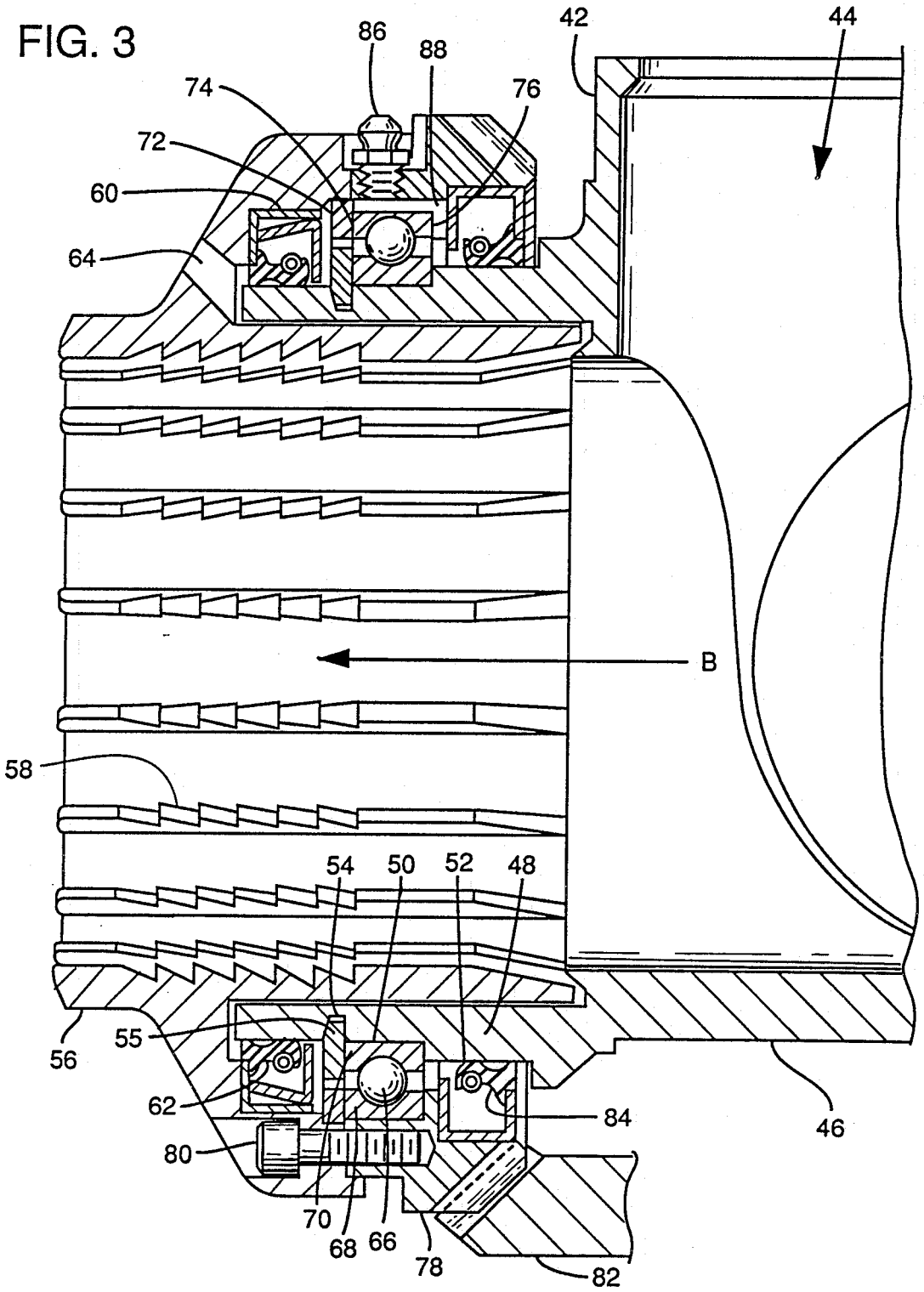
FIG. 3 is a partial vertical cross section of the impeller assembly of the present invention.

FIG. 1 and FIG. 2 show the current or prior art embodiment of the Urschel apparatus used to produce waffle cut potatoes. The present invention, shown in FIG. 3, is an improvement over this current machine and a detailed description will be given of the differences between the Urschel device and the present invention.

Referring to FIG. 1, a fixed knife support 2 is located on a frame (not shown) and holds a plurality of knives 4. An impeller assembly 10 is located centrally within the periphery of surrounding knife support 2. The impeller assembly includes an impeller hub 12 having a top opening to provide a means to receive the product to be sliced. This impeller hub has a plurality of tubular extensions 14 extending radially outward from the impeller hub 12. In the embodiment shown in FIG. 1 there are four tubular extensions which rotate past four knives 4. The impeller assembly also includes impeller tubes 16, each located such that its central-most portion is axially within one of the tubular extensions. The impeller tube 16 being hollow receives the product to be sliced and displaces the product outwardly under centrifugal force against the knives. Each impeller tube 16 is attached to an impeller bevel gear 18 by means of suitable fasteners 20. Captivated between the impeller tube 16 and the impeller bevel gear 18 is a ball bearing 22. These bearings are approximately 6 inches in diameter and typically have an average life of approximately 250 hours in a potato slicing environment.

The enlarged view of FIG. 2 shows the arrangements of the various components that make up the impeller assembly. Again, the impeller hub 12 has a tubular extension 14 extending therefrom. The impeller tube 16 is attached to the impeller bevel gear 18 by means of a suitable fastener 20. The bearing 22 can be seen entrapped between the impeller bevel gear 18 and the tubular extension 14 of the impeller hub 12. The tubular extension has a step 30 upon which the inner race of the bearing bears. The bearing is retained in a pocket formed between the tubular extension and impeller bevel gear by a snap ring 26 which fits into a groove 32 in the tubular extension of the impeller hub. A boss on the impeller tube entraps the outer race of the bearing between the impeller tube and the impeller bevel gear.

In operation, a product P to be sliced is placed into the central opening of the impeller hub 12 generally along the center line marked O in FIG. 1. The product P is flung radially outwardly by centrifugal force along arrow B into one of impeller tubes. The product eventually ends up in a position P' (FIG. 1) whereupon it is slicingly engaged by one of the knives 4. The impeller hub assembly continues to rotate in the direction of the arrow A by means of a shaft through the frame (not shown). This rotation is in a first plane parallel to the plane of the frame. The stationary bevel gear 24 being in engagement with each of the impeller bevel gears 18 would cause the impeller tube 16 to rotate. This rotation would cause the product P' to be rotated 90 degrees between successive slices of the knives 4. This rotation of the impeller tube is in a second plane which is perpendicular to the first plane.

During operation moisture and solid particulate material flows along arrow C in between the tubular extension of the impeller hub and the portion of the impeller tube along arrow D. The moisture then penetrates between the snap ring and the spacer into the central bearing area and finally exits the assembly along arrow E.

Referring now to FIG. 3, a vertical cross-section of a portion of the impeller assembly of the present invention is shown. The cross-section is taken through one of the tubular extensions of the impeller hub assembly. The impeller hub 42 has a vertical opening 44 which receives the product to be sliced. A solid floor 46 is immediately below the opening 44 and is attached to a vertical shaft (not shown) which rotates the impeller hub 42. This impeller hub is a first member. A tubular extension 48 of the impeller hub has a first step 50 and a second step 52. The first step is about the circumferential periphery of the tubular extension and is smaller in diameter than the second step 52. A groove 54 is machined about the periphery of the first step 50 of the tubular extension of the impeller hub. A snap ring 55 fits into groove 54.

An impeller tube 56 has a hollow tubular end portion that fits inside the tubular extension of the impeller hub. The outer diameter of the tubular end portion is slightly less than the inner diameter of the tubular extension. The tubular end portion has serrated teeth 58 projecting along the length of the inside thereof. These serrated teeth allow the product to be sliced to progress in the direction of arrow B but prevents the product to be sliced from falling back toward the opening 44. Impeller tube 56 has a recess 60 machined about its inside periphery. Recess 60 is manufactured to accommodate a first seal 62. Seal 62 is a smoothlip bidirectional seal. The impeller tube also has an open passageway 64 to allow any water which enters between the impeller tube 56 and the tubular extension 48 to exit without creating pressure on seal 62. A bearing 66 is restrained on the first step of the tubular extension of the impeller hub and held in place by the snap ring 55. Bearing 66 has an outer race 68 and an inner race 70. The snap ring 55 bears against one side of the inner race 70, with the other side of race 68 abutting a lip formed by the first step. The bearing 66, in the preferred embodiment, is a ball bearing.

The spacer 72 is a flat circular member having an inside diameter larger in diameter than the outside diameter of the snap ring. The bearing races have a first face 74. The first face of the inner race of the bearing 66 bears against the snap ring 55 while the first face of the outer race bears against the spacer 72. The bearing has a second face 76 opposite the first face 74. The second face of the inner race 70 bears against the step of the tubular extension of the impeller hub. The second face of the outer race 68 bears against a lip portion of an impeller bevel gear 78. Impeller bevel gear 78 is attached to impeller tube 56 by means of suitable fasteners, such as set screws 80. Bevel gear 78 is in tooth-to-tooth engagement with a fixed bevel gear 82. The fixed bevel gear is attached to the frame (not shown). The combination of the impeller tube 56, the impeller bevel gear 78, the spacer 72 and the fasteners 80 constitutes a second member of the impeller assembly.

A second seal 84 has a surface which rides on the impeller gear 78 and a second surface which contacts the tubular extension 48 of the impeller hub 42 along the second step 52. The second seal 84, in the preferred embodiment, is a smoothlip bidirectional seal.

A grease fitting 86 is threaded into the impeller bevel gear. The grease fitting 86 allows grease to be forced into a grease channel 88. The grease channel communicates the grease through the bearing and against both the first seal 62 and the second seal 84. The grease therefore is captivated between the seals and cannot exit the bearing area to cause contamination of food products. A lubricating grade grease which is not rated for human consumption may thus be used to lubricate the bearing. Any moisture which would pass between the impeller tube and the tubular extension of the impeller hub is slung out through opening 64 and cannot contaminate the bearings.

In operation, moisture, particulate matter and contaminants entering the seam between the impeller tube and tubular extension are prevented by seal 62 from contaminating bearing 66. The effectiveness of seal 62 as a protective barrier is further enhanced by passageway 64 which allows such moisture and contaminants to be shunted away from the bearing area by centrifugal force and exit the impeller tube. This self-cleaning feature also reduces the tendency of moisture and contaminants to build up pressure adjacent the seal and thereby cause degradation or break down of the seal barrier.

Seal 84 seals the other side of the bearing and prevents dust, dirt or other contaminants from entering the spacing between the impeller bevel gear and tubular extension and causing degradation of the bearing.

In this way, the life of the bearing is increased substantially, resulting in significantly lower maintenance costs and less down time to the apparatus.

Having described the invention, it is to be understood that many modifications and variations both in its structure and operation equivalent may be adapted by those skilled in the art without departing from the spirit of the present invention. The invention, therefore, should only be limited in its various modifications and variations as is defined in the scope of the appended claims.

I claim:

1. An apparatus for slicing vegetables comprising:

an impeller hub to receive a product to be sliced;

a plurality of tubular extensions projecting outwardly from said impeller hub, each of said tubular extensions having a first step and a second step about the periphery thereof;

a means to rotate the impeller hub in a first plane;

a plurality of impeller tubes, one of said plurality of impeller tubes located inside each of said plurality of tubular extensions, to displace the product to be sliced outwardly;

a means to rotate the impeller tubes within the impeller hub in a second plane, said second plane being perpendicular to the first plane;

a plurality of impeller bevel gears associated with said means to rotate said impeller tubes, one of said plurality of bevel gears located outside of each of said plurality of tubular extensions, and attached to the impeller tube within each of said tubular extensions;

a plurality of bearings, each of said bearings having a first surface and a second surface, one of said plurality of said bearings positioned between each of said tubular extensions of said impeller hub on said first step of said tubular extension and said impeller bevel gear to locate said impeller bevel gear about said tubular extension of said impeller hub and to locate said impeller tube within said tubular extension of said impeller hub;

a first seal positioned on the second step of each of said tubular extensions between said tubular extension and said bevel gear to seal the first surface of said bearing;

a second seal positioned on the first step of each of said tubular extensions between said tubular extension and said impeller tube to seal the second surface of said bearing; and a means to hold stationary knives radially about the displacement means to slice the product.

2. An apparatus for slicing vegetables as recited in claim 1 wherein the impeller hub includes a vertical opening for receiving the product and a closed floor.

3. An apparatus for slicing vegetables as recited in claim 2 wherein each of the bearings is a ball bearing which mounts on the first step of said tubular extension.

4. An apparatus for slicing vegetables as recited in claim 1 wherein the means to rotate the impeller tubes is a stationary bevel gear in tooth to tooth engagement with said impeller bevel gears, said stationary bevel gear attached rigidly to a frame and said impeller bevel gears each having a means to lubricate said bearings.

5. An apparatus for slicing vegetables comprising:

a frame a stationary member carried by said frame;

a plurality of radially spaced knives attached to said stationary member;

a first member rotatable in a first plane mounted inside said stationary member for receiving a product to be sliced;

a second member mounted on said first member for conveying said product to be sliced outwardly against said knives, said second member rotatable about said first member in a second plane;

a bearing having a first side and a second side, said bearing affixed between said first member and said second member;

a first seal located between said first member and said second member on the first side of said bearing;

a second seal located between said first member and said second member on the second side of said bearing;

an opening in said second member to allow water and other contaminants to exit from between said first member and said second member to prevent water and other contaminants from bypassing said first seal or said second seal.

6. An apparatus for slicing vegetables as recited in claim 5 wherein the first member is an impeller hub, said impeller hub having a top opening for receiving a product to be sliced and a plurality of tubular extensions extending radially from said impeller hub, each of said tubular extensions having a first step and a second step.

7. An apparatus for slicing vegetables as recited in claim 5 wherein said second member is comprised of an impeller tube, an impeller bevel gear, a spacer and a means to attach said impeller bevel gear to said impeller tube.

8. An apparatus for slicing vegetables comprising:

a frame;

a stationary member affixed to said frame;

a plurality of knives radially attached to said stationary member;

an impeller hub for receiving a product to be sliced, said impeller hub located inside said stationary member and said impeller hub having a plurality of tubular extensions projecting outwardly therefrom, said tubular extensions having a first step and a second step about the outside periphery thereof, the diameter of said second step being greater than the diameter of said first step;

a groove about the first step of each of said tubular extensions of said impeller hub;

said tubular extensions comprising:

an impeller tube for directing the product to be sliced outwardly against said knives, said impeller tube located inside each of the tubular extensions of said impeller hub;

an impeller bevel gear for attachment to said impeller tube;

a stationary bevel gear attached to said frame for rotating said impeller bevel gear and said attached impeller tube about each of the tubular extensions of said impeller hub;

a bearing having an inner race with a first surface and a second surface and an outer race with a first surface and a second surface;

a snap ring fitting in said groove of each tubular extension of said impeller hub to restrain the inner race of the bearing between the snap ring and the first step of each of the tubular extensions of the impeller hub such that the first surface of the inner race of the bearing contacts the first step of the tubular extension of the impeller hub and the second surface of the inner race of the bearing contacts the snap ring;

an impeller spacer located between the impeller tube and the outer race of the bearing such that the first surface of the outer race of the bearing contacts the impeller bevel gear when said gear has been assembled to the impeller tube and the second surface of the outer race of the bearing contacts the impeller spacer, said impeller spacer having an inside diameter greater than the outside diameter of said snap ring;

a first seal captivated between each tubular extension of said impeller hub and said impeller tube between said snap ring and said impeller tube thus producing a seal of the first surface of the inner and outer races of said bearing; and a second seal captivated between each said tubular extension of said impeller hub and said impeller bevel gear thus producing a seal of the second surface of the inner and outer races of said bearing.

9. An apparatus for slicing vegetables as recited in claim 8 wherein the impeller tube has an opening for allowing water and other contaminants to exit from between the impeller tube and the tubular extension of the impeller hub.

10. An apparatus for slicing vegetables as recited in claim 8 wherein a means to lubricate the bearing is incorporated into the impeller bevel gear.

* * * * *